US008657423B2

(12) United States Patent
Gonzales

(10) Patent No.: US 8,657,423 B2
(45) Date of Patent: Feb. 25, 2014

(54) FLUID CONTAINER

(75) Inventor: Curt Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 284 days.

(21) Appl. No.: 12/945,466

(22) Filed: Nov. 12, 2010

(65) Prior Publication Data

US 2011/0057999 A1 Mar. 10, 2011

Related U.S. Application Data

(63) Continuation of application No. PCT/US2008/063392, filed on May 12, 2008.

(51) Int. Cl.
*B41J 2/175* (2006.01)

(52) U.S. Cl.
USPC ..... 347/86; 347/85

(58) Field of Classification Search
USPC ..... 347/85, 86
See application file for complete search history.

(56) References Cited

U.S. PATENT DOCUMENTS

| | | | |
|---|---|---|---|
| 6,764,169 | B2 | 7/2004 | Hall et al. |
| 6,863,388 | B2 | 3/2005 | Seino et al. |
| 2005/0018014 | A1 | 1/2005 | Butty et al. |
| 2005/0168545 | A1 | 8/2005 | Sakai et al. |
| 2008/0018718 | A1 | 1/2008 | Ishizawa |

FOREIGN PATENT DOCUMENTS

| | | |
|---|---|---|
| KR | 1020050063722 | 6/2005 |
| KR | 1020050107341 | 11/2005 |

OTHER PUBLICATIONS

Written Opinion of the International Searching Authority for PCT/US 2008/063392, Nov. 25, 2008.
PCT International Search Report and Written Opinion for PCT/US2008/063392, Nov. 25, 2008.

*Primary Examiner* — Jannelle M Lebron
(74) *Attorney, Agent, or Firm* — Steven R. Ormiston

(57) ABSTRACT

In one embodiment a fluid container includes: a housing having a chamber therein for holding a fluid, the housing defined at least in part by a rectangular box and a one piece, L-shaped lid; and a first leg of the lid extending along and closing a first, open side of the box and a second leg of the lid extending along and interlocked with a closed, second side of the box disposed perpendicular to the first side of the box.

18 Claims, 5 Drawing Sheets

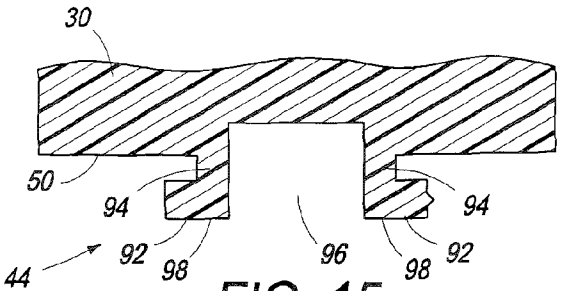
FIG. 14
FIG. 15
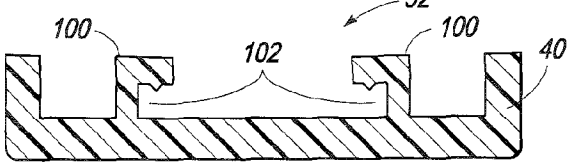
FIG. 16
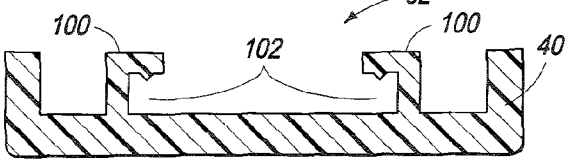
FIG. 17
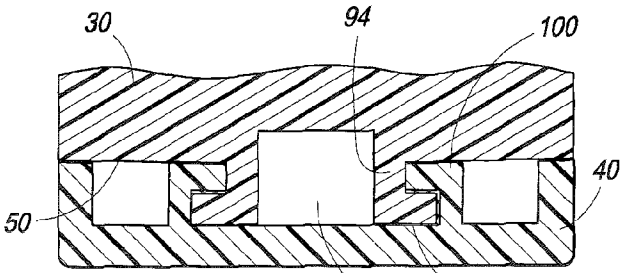
FIG. 18
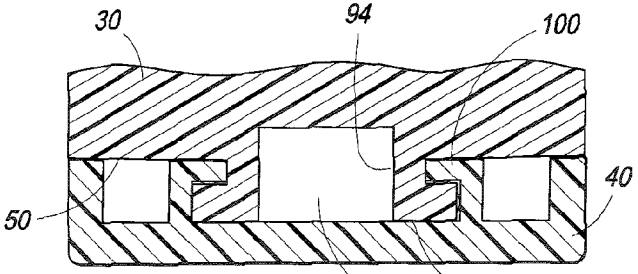
FIG. 19

FLUID CONTAINER

CROSS-REFERENCE TO RELATED PATENT APPLICATIONS

The present application is a continuation of co-pending PCT/U.S.2008/063392 filed on May 12, 2008 by Curt Gonzales and entitled FLUID CONTAINER, the full disclosure of which is hereby incorporated by reference

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer. Alternatively, one or more printheads may be mounted on a stationary carriage, as in a page-wide printhead array. A printhead may be an integral part of an ink cartridge or part of a discrete assembly to which ink is supplied from a separate, often replaceable ink container.

DRAWINGS

Figure 3:
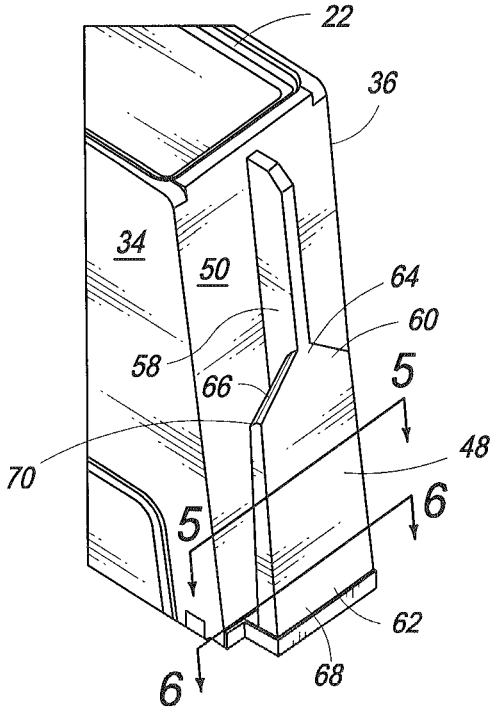
FIG. 3 is a close-up perspective view of a portion of the body of the container housing of FIG. 1 showing in more detail the dual-taper key on the side of the body that interlocks with a mating keyway on the lid.
Figure 5:
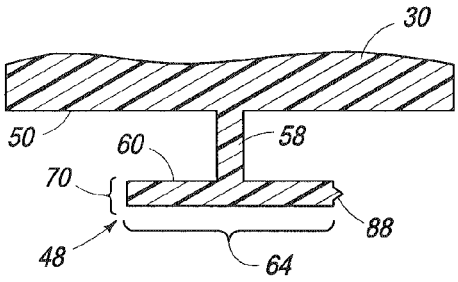
Figure 6:
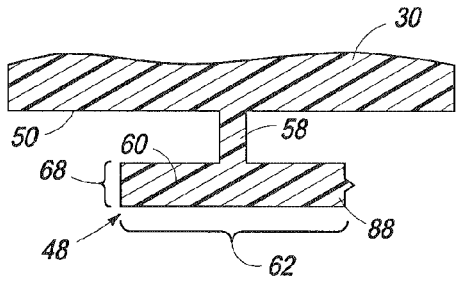

FIGS. 5 and 6 are section views taken along the lines 5-5 and 6-6 in FIG. 3.

Figure 4:
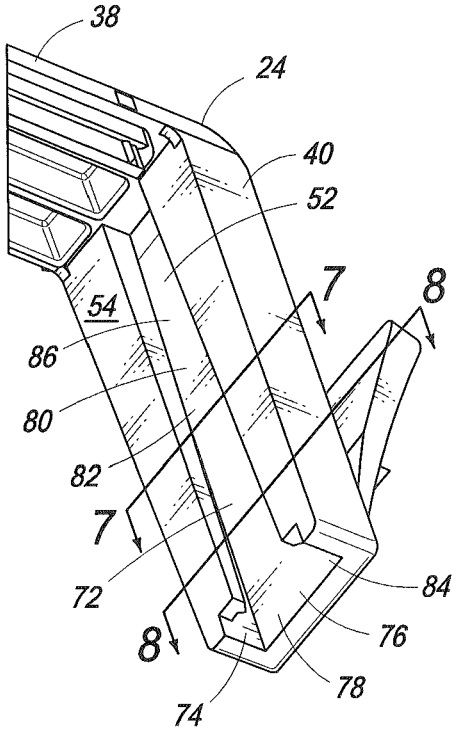
FIG. 4 is a close-up perspective view of a portion of the lid of the container housing of FIG. 1 showing in more detail the dual-taper keyway in the lid that interlocks with the mating key on the body.
Figure 7:
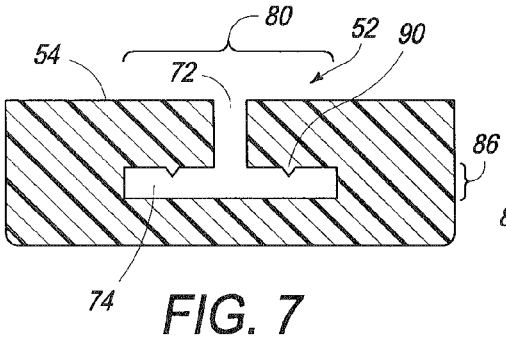
Figure 8:
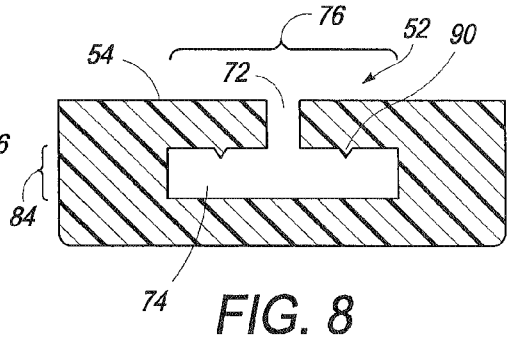

FIGS. 7 and 8 are section views taken along the lines 7-7 and 8-8 in FIG. 4.

Figure 9:
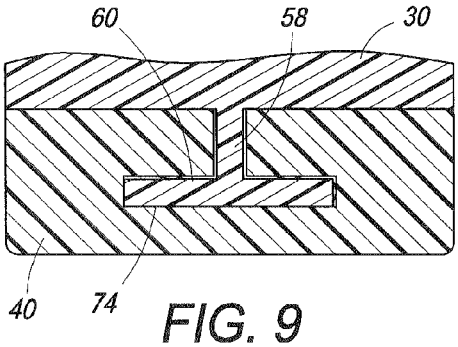

FIG. 9 is a section view showing the lid assembled to the body at the location of the component sections shown in FIGS. 5 and 7.

Figure 10:
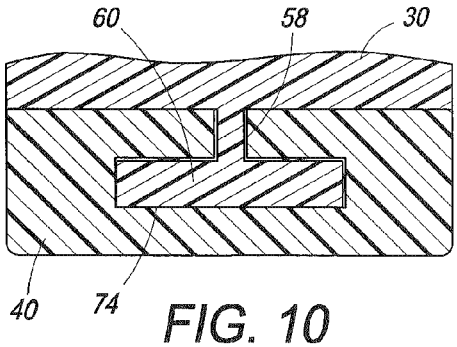

FIG. 10 is a section view showing the lid assembled to the body at the location of the component sections shown in FIGS. 6 and 8.

Figure 11:
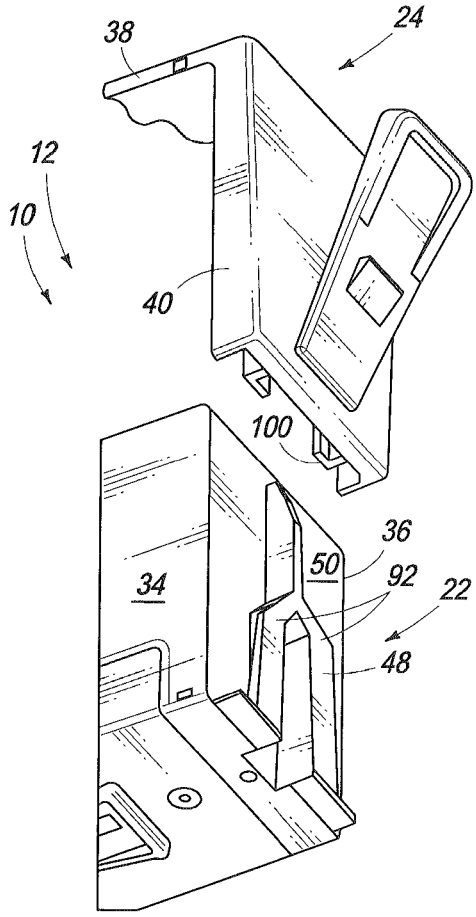

FIG. 11 is a perspective, exploded view of a portion of an ink container according to another embodiment of the disclosure.

Figure 12:
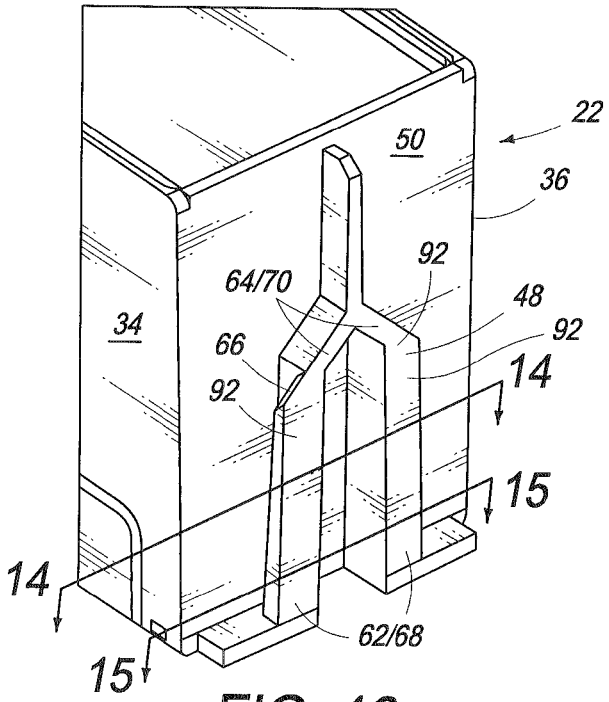

FIG. 12 is a close-up perspective view of a portion of the body of the ink container housing of FIG. 11 showing in more detail the dual-taper key on the side of the body that interlocks with a mating keyway on the lid.

Figure 13:
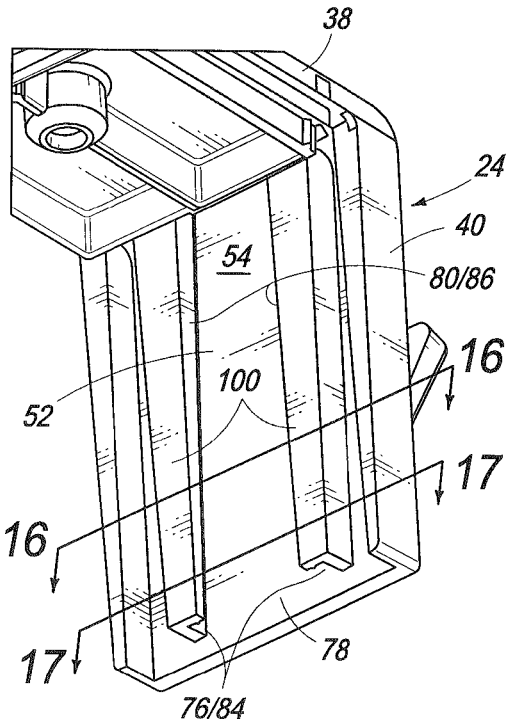

FIG. 13 is a close-up perspective view of a portion of the lid of the container housing of FIG. 11 showing in more detail the dual-taper keyway in the lid that interlocks with the mating key on the body.

FIGS. 14 and 15 are section views taken along the lines 14-14 and 15-15 in FIG. 12.

FIGS. 16 and 17 are section views taken along the lines 16-16 and 17-17 in FIG. 13.

FIGS. 18 and 19 are section views showing the lid assembled to the body at the locations corresponding to the component sections shown in FIGS. 14 and 16 (FIG. 18) and FIGS. 15 and 17 (FIG. 19).

DESCRIPTION

The housing for a replaceable ink container is constructed from two separate molded plastic parts welded together—a body and a lid covering the open top of the body. Where several different colored inks are supplied from a corresponding number of individual ink containers, it may be desirable to match the color of the container to the color of the ink in the container to help the user correctly install each ink container. It is more economical to match the color of the smaller lid to the color of the ink than it is to match the color of the larger body (or the entire housing) to the ink color. The latch used to secure the ink container in the printer may be molded as part of the body of the container housing, which means the latch will be the same color as the body and not the same color as the lid or the ink.

A wrap-around lid, in which the latch is molded as part of the lid, makes it more economical to match the latch color with the ink color. In some embodiments, it may be desirable for a wrap-around lid to be held tightly to the body both for function and for looks. If that part of the lid near the latch is not held tightly, then it may not align properly with the body, making it difficult to install the ink container into the printer. If the lid flexes to either side, then the container is, in effect, wider than it should be and, if it flexes outward, then the container is, in effect, longer than it should be. A container that is too wide or too long may not fit or function properly in the printer. In addition, a lid that feels loose to the user may give the impression that the container is defective or broken.

Embodiments of the present disclosure were developed as part of an effort to design a wrap-around lid for a replaceable ink container that can be secured tightly to the body of the container for both proper function and desirable looks. Exemplary embodiments of the disclosure will be described, therefore, with reference to a replaceable inkjet printer ink container. Embodiments of the disclosure, however, are not limited to ink containers. Other forms, details, and embodiments may be made and implemented. Hence, the following description should not be construed to limit the scope of the disclosure, which is defined in the claims that follow the description.

Figure 1:
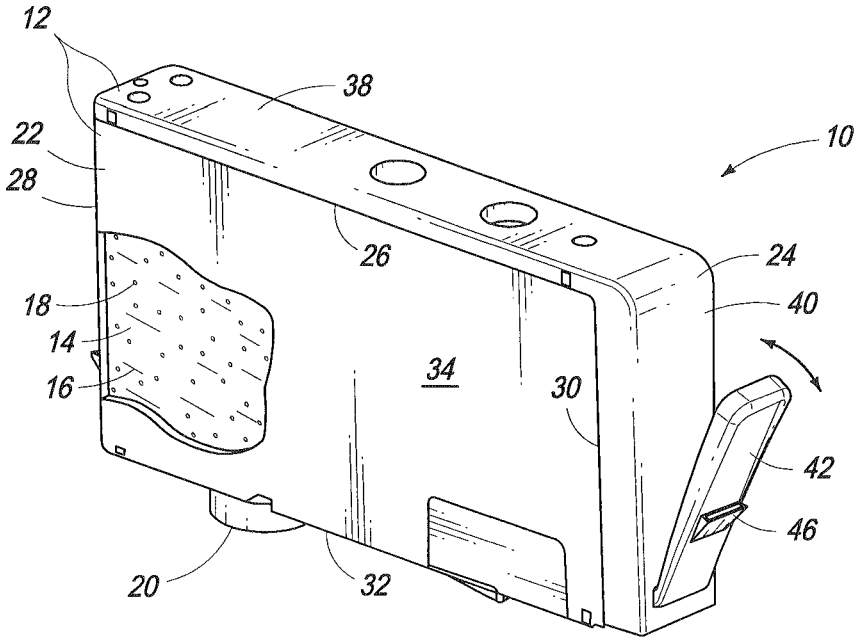
FIGS. 1 and 2 are perspective views of an ink container according to one embodiment of the disclosure. The wrap-around lid is partially exploded away from the body of the container housing in FIG. 2.
Figure 2:
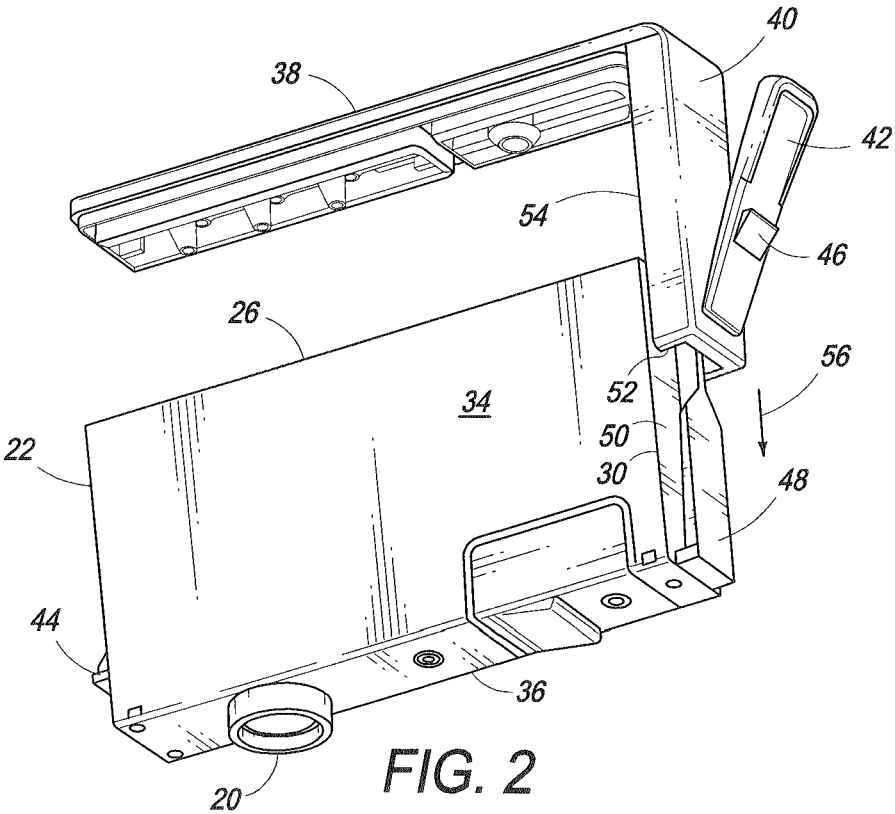

FIGS. 1 and 2 are perspective views of an inkjet printer ink container 10 according to one embodiment of the disclosure. Referring to FIGS. 1 and 2, container 10 includes a housing 12 that forms an internal chamber 14 for holding ink 16. Ink 16 may be held in chamber 16 in a foam block 18 or other suitable ink holding material. Ink 16 may flow from container 10 to a printhead or other downstream component through an outlet 20 at the bottom of housing 12. Housing 12 includes a body 22 and a lid 24. Body 22 is a generally rectangular box that includes an open top part 26 and closed front, rear, bottom and side parts 28, 30, 32 and 34, 36. Lid 24 is a one piece generally L-shaped part that wraps around the top and rear parts 26 and 30 of body 22. A first leg 38 of lid 24 extends along and closes body top part 26 and a second leg 40 of lid 24 extends along and is interlocked with body rear part 30, as described in detail below.

A spring loaded lever latch 42 is integrated into or otherwise operatively affixed to lid second leg 40. For example, latch 42 and lid 24 will typically be molded together as a single part in which latch 42 is biased by its structural configuration to resist pivoting in toward container body 22. Thus, when latch 42 is pivoted/compressed in toward container body 22 during installation of container 10 into a receiving bay (not shown), it will tend to "spring back" away from body 22 to help latch container 10 into position in the receiving bay. In the embodiment shown, container 10 is secured into a receiving bay through a projecting key 44 at body front 28 and lever latch 42 on lid second leg 40 at body rear 30. For installation, key 44 is fitted into a mating keyway on the printhead assembly or other receiving part (not shown) and a catch 46 on lever latch 42 snaps into the receiving part as the rear of container 10 is rotated down into the receiving bay. For removal, lever latch 42 is pivoted forward to release catch 46 so that the rear of container 10 may be rotated up and out of the receiving bay.

Referring to FIG. 2, a key 48 is formed along the outside surface 50 of body rear 30. A mating keyway 52 is formed along the inside surface 54 of lid second leg 40. Key 48 and keyway 52 are configured with respect to one another such that lid second leg 40 fits tightly together with body rear part 30 when lid 24 is assembled to body 22. For example, second leg 40 of lid 24 is slid down on to body rear part 30, as indicated by direction arrow 56 in FIG. 2, until fully in place on body 22 as shown in FIG. 1. Then, lid first leg 30 is welded or otherwise affixed to body 22 along top 26 to secure lid 24 tightly in place on body 22. This lid-to-body interlock hides the lid retaining features of housing 12, giving container 10 a clean look, while providing an economically viable way to match the latch color to the ink color.

FIG. 3 is a close-up perspective view of a portion of container body 22 showing key 48 in more detail. FIG. 4 is a close-up perspective view of a portion of container lid 24 showing keyway 52 in more detail. FIGS. 5 and 6 are section views taken along the lines 5-5 and 6-6 in FIG. 3 and FIGS. 7 and 8 are section views taken along the lines 7-7 and 8-8 in FIG. 4. FIG. 9 is a section view showing lid 24 assembled to body 22 at the location of the component sections shown in FIGS. 5 and 7. FIG. 10 is a section view showing lid 24 assembled to body 22 at the location of the component sections shown in FIGS. 6 and 8.

Referring first to FIGS. 3, 5 and 6, body key 48 is a dual taper, generally T-shaped part protruding from and extending along body outside surface 50. T-shaped key 48 may be characterized as having a stem 58 and a crossbar 60. Stem 58 extends for substantially the full length of surface 50. Crossbar 60 tapers in width from a wider section 62 at the bottom of outside body surface 50 to a narrower section 64 at a leading edge 66 about mid-way up surface 50. Leading edge in this context refers to the sequence of motion of assembling lid 24 to body 22. Hence, leading edge 66 is that part of crossbar 60 that leads into keyway 52. Crossbar 60 also tapers in thickness from a thicker section 68 corresponding to wider section 62 at the bottom of outside body surface 50 to a thinner section 70 at leading edge 66. Crossbar 60 may taper in width gradually, as shown, for substantially its full extent and then taper sharply into stem 58 at leading edge 66.

Referring now to FIGS. 4, 7 and 8, lid keyway 52 is a dual taper, generally T-shaped slot matching key 48 and extending along lid inside surface 54. T-shaped keyway 52 may be characterized as having a stem opening 72 and a crossbar opening 74. Stem opening 72 extends for substantially the full length of surface 54. Crossbar opening 74 tapers in width from a wider section 76 at a bottom, leading edge 78 of inside lid surface 54 to a narrower section 80 at a middle part 82 of surface 54 corresponding to the location of body key leading edge 66. Crossbar opening 74 also tapers in depth from a deeper section 84 corresponding to wider section 76 at lid leading edge 78 to a shallower section 86 at middle part 82.

In the embodiment shown, key 48 and keyway 52 both include biasing spacers 88 and 90 that help ensure lid 24 fits tightly on body 22. Spacer 88 is molded into or otherwise formed along one end of key crossbar 60 to bias crossbar 60 in the side to side direction against the opposite end of crossbar opening 74 in keyway 52. Spacers 90 are molded into or otherwise formed along one wall of crossbar opening 74 to bias key crossbar 60 in the front to back direction against the opposite wall of crossbar opening 74. Spacers 88 and 90 are sized and shaped to secure but not impede a tight fit for dimensional variations in the parts due to manufacturing tolerances. That to say, spacers 88 and 90 are configured to fill gaps between otherwise loosely fitting parts and to deform, and/or deform the contacting part, so that the spacers 88 and 90 do not impede the assembly of closely fitting parts. Of course, other suitable spacer configurations may be used (or biasing spacers may not be necessary or desirable at all in some implementations).

This dual taper configuration for key 48 and keyway 52 facilitates easy assembly while still enabling a tight fit. Referring again to FIG. 2, the wider and deeper sections 76 and 84 of keyway 52 slide easily over the narrower and thinner sections 64 and 70 of key 48 as lid 24 is assembled on to body 22. As lid 24 reaches the fully assembled position shown in FIG. 1, the matching dual tapers of key 48 and keyway 52 converge to lock lid 24 tightly on to body 22, as best seen in the section views of FIGS. 9 and 10. The interlocking fit is secured by, for example, welding lid 24 to body 22 along top 26 using the same thermal or ultrasonic welding processes presently used to secure a conventional ink container lid. Although a dual taper configuration such as that shown and described may not be necessary or desirable in all implementations, the ease with which the dual taper may be implemented in the fabrication of molded plastic parts such as container housing body 22 and lid 24 makes it an attractive and economically viable feature for enabling a tight fit between these parts of the ink container.

FIGS. 11-19 illustrate another embodiment, implementing a variation of the interlocking system described above, that might be used for larger ink containers, such as a black ink container which is often larger than the other color ink containers. For convenience, the same part numbers are used to designate the same or similar structural features in both embodiments. Referring to FIGS. 11-19, in this alternative embodiment a wider key 48 on body 22 and a corresponding wider keyway 52 on lid 24 is used to achieve the desired interlocking fit for the larger container 10. The T-shapes of key 48 and keyway 52 are retained, but modified to reduce the volume of material needed for form each shape. For key 48, the modified T-shape looks as if a solid T (as in the first embodiment) is split in half lengthwise along the stem with each half moved outward along surface 50 toward body sides 34 and 36. Similarly, for keyway 52, the modified T-shape looks as if the T-shaped slot has been split in half lengthwise along the stem with each half of the slot moved outward along surface 54 toward the sides of lid 24.

T-shaped key 48 is formed with a pair of L-shaped flanges 92 that extend generally parallel to one another along outside surface 50, effectively "removing" part of the center portion of the T shape. As best seen in the section view of FIGS. 14 and 15, instead of a T with a solid stem and crossbar (as in the first embodiment), the stem of the T is split into a pair of flange legs 94 separated by a gap 96 and the crossbar of the T is split into a pair of flange legs 98 separated by gap 96. Crossbar flange legs 98 taper in width from a wider section 62 at the bottom of outside body surface 50 to a narrower section 64 at a leading edge 66 about mid-way up surface 50, where flanges 92 converge with one another. Each crossbar flange leg 98 also tapers in thickness from a thicker section 68 corresponding to wider section 62 at the bottom of outside body surface 50 to a thinner section 70 at leading edge 66.

T-shaped keyway 52 is formed with a pair of L-shaped flanges 100 each defining a slot 102 matching key each key flange 92 and extending along lid inside surface 54. T-shaped keyway 52 may be characterized as having a stem opening 72 and a crossbar opening 74. Stem opening 72 extends for substantially the full length of surface 54. Crossbar opening 74 tapers in width from a wider section 76 at a bottom, leading edge 78 of inside lid surface 54 to a narrower section 80 at a middle part 82 of surface 54 corresponding to the location of body key leading edge 66. Each slot 102 of crossbar opening 74 tapers in depth from a deeper section 84 corresponding to wider section 76 at lid leading edge 78 to a shallower section 86 at middle part 82.

As noted at the beginning of this Description, the exemplary embodiments shown in the figures and described above illustrate but do not limit the disclosure. Other forms, details, and embodiments may be made and implemented. The foregoing description, therefore, should not be construed to limit the scope of the disclosure, which is defined in the following claims.

What is claimed is:

1. A fluid container, comprising:

a housing having a chamber therein for holding a fluid, the housing defined at least in part by a body and a one piece, L-shaped lid; and a first leg of the lid extending along and closing a first, open side of the body and a second leg of the lid extending along and interlocked with a closed, second side of the body.

2. The container of claim 1, wherein a color of the lid indicates a color of a fluid in the container.

3. The container of claim 1, wherein the lid comprises a molded plastic lid that includes a latch on the second leg of the lid for helping to secure the container in a receiving part, and a color of the plastic forming the lid and the latch matches a color of a fluid held in the chamber.

4. The container of claim 1, wherein the second leg of the lid is interlocked with the second side of the body through a key on an outside surface of the second side of the body fitted into a mating keyway on an inside surface of the second leg of the lid.

5. The container claim 4, wherein the key comprises a stem extending from the second side of the body and a crossbar extending from the stem.

6. The container of claim 5, wherein the stem is split into a pair of flange legs separated by gap.

7. A fluid container, comprising:

a housing having a chamber therein for holding a fluid, the housing defined at least in part by a rectangular box and a one piece, L-shaped lid;

a first leg of the lid extending along and closing a first, open side of the box and a second leg of the lid extending along a closed, second side of the box disposed perpendicular to the first side of the box; and a key on one of an outside surface of the second side of the box or an inside surface of the second leg of the lid, and a mating keyway on the other of the outside surface of the second side of the box or the inside surface of the second leg of the lid, the key and keyway configured with respect to one another such that the second leg of the lid fits tightly together with the second side of the box.

8. The container of claim 7, wherein a color of the lid indicates a color of a fluid in the container.

9. The container of claim 7, wherein the lid comprises a molded plastic lid that includes a latch on the second leg of the lid for helping to secure the container in a receiving part and a color of the plastic forming the lid and the latch matches a color of a fluid held in the chamber.

10. The container of claim 7, wherein the key comprises a stem extending from the second side of the body and a crossbar extending from the stem.

11. The container of claim 10, wherein the stem is split into a pair of flange legs separated by gap.

12. The container of claim 7, wherein the key is formed on the outside surface of the second side of the box and the mating keyway is formed on the inside surface of the second leg of the lid.

13. The container of claim 12, wherein:

the key includes a T-shaped part protruding from and extending along the outside surface of the second side of the box; and the keyway includes a T-shaped slot extending along the inside surface of the lid.

14. The container of claim 13, wherein:

the T-shaped part includes a stem and a crossbar, the crossbar tapering in width from a wider section at a bottom of the outside surface of the second side of the box to a narrower section at a leading edge away from the bottom of the outside surface of the second side of the box, and the crossbar tapering in thickness from a thicker section at the wider section of the crossbar to a thinner section at the narrower section of the crossbar; and the T-shaped slot includes a stem opening and a crossbar opening, the crossbar opening tapering in width from a wider section at a leading edge of the inside surface of the lid to a narrower section corresponding to a location of the cross bar leading edge, and the crossbar opening tapering in depth from a deeper section at the wider section of the crossbar opening to a shallower section at the narrower section of the crossbar opening.

15. The container of claim 14, further comprising spacers on the crossbar and/or on sidewalls of the crossbar opening configured to bias the crossbar toward adjoining sidewalls of the crossbar opening.

16. A fluid container, comprising a housing having a chamber therein for holding a fluid, the housing defined at least in part by:

a molded plastic body; and a molded plastic lid that includes a latch for helping to secure the container in a receiving part, the lid affixed to the body and extending along and closing an open part of the body and the lid and the latch having a color matching a color of the fluid held in the chamber, wherein the lid is interlocked with the body through a key formed along an outside surface of the body fitted into a mating keyway formed along an inside surface of the lid.

17. The container of claim 16, wherein the key comprises a stem extending from the second side of the body and a crossbar extending from the stem.

18. The container of claim 17, wherein the stem is split into a pair of flange legs separated by gap.

* * * * *

UNITED STATES PATENT AND TRADEMARK OFFICE

CERTIFICATE OF CORRECTION

PATENT NO. : 8,657,423 B2
APPLICATION NO. : 12/945466
DATED : February 25, 2014
INVENTOR(S) : Curt Gonzales It is certified that error appears in the above-identified patent and that said Letters Patent is hereby corrected as shown below:

In the Claims:

In column 5, line 42, in Claim 5, after "container" insert -- of --.

Signed and Sealed this
Third Day of June, 2014

Michelle K. Lee

Michelle K. Lee
*Deputy Director of the United States Patent and Trademark Office*